US007245699B2

(12) United States Patent
Verman et al.

(10) Patent No.: US 7,245,699 B2
(45) Date of Patent: Jul. 17, 2007

(54) X-RAY OPTICAL SYSTEM WITH ADJUSTABLE CONVERGENCE

(75) Inventors: Boris Verman, Bloomfield, MI (US); Licai Jiang, Rochester Hills, MI (US)

(73) Assignee: Osmic, Inc., Auburn Hills, MI (US)

( * ) Notice: Subject to any disclaimer, the term of this patent is extended or adjusted under 35 U.S.C. 154(b) by 1 day.

(21) Appl. No.: 10/787,516

(22) Filed: Feb. 26, 2004

(65) Prior Publication Data

US 2004/0170250 A1 Sep. 2, 2004

Related U.S. Application Data

(60) Provisional application No. 60/451,118, filed on Feb. 28, 2003.

(51) Int. Cl.
*G21K 1/06* (2006.01)

(52) U.S. Cl. ..... 378/85; 378/84

(58) Field of Classification Search ..... 378/84, 378/85, 145

See application file for complete search history.

(56) References Cited

U.S. PATENT DOCUMENTS

| | | | | |
|---|---|---|---|---|
| 2,542,196 | A | 2/1951 | Haupt | |
| 3,160,749 | A | 12/1964 | Spielberg | |
| 3,852,594 | A | 12/1974 | Paolini | 378/81 |
| 3,944,833 | A | 3/1976 | Hounsfield | 378/19 |
| 4,958,363 | A | 9/1990 | Nelson et al. | 378/85 |
| 5,204,533 | A | 4/1993 | Simonet | 378/63 |
| 5,237,599 | A | 8/1993 | Gunji et al. | |
| 5,249,215 | A | 9/1993 | Shimano | |
| 5,406,611 | A | 4/1995 | Schobert et al. | |
| 5,757,881 | A | 5/1998 | Hughes | |
| 6,014,423 | A | 1/2000 | Gutman et al. | |
| 6,041,099 | A | 3/2000 | Gutman et al. | |
| 6,226,349 | B1 | 5/2001 | Schuster et al. | 378/84 |
| 6,330,301 | B1 | 12/2001 | Jiang | |
| 6,493,421 | B2 | 12/2002 | Gutman | |
| 6,504,902 | B2 | 1/2003 | Iwasaki et al. | |
| 2001/0028699 | A1 | 10/2001 | Iwasaki | |
| 2002/0064253 | A1 | 5/2002 | Gutman | |
| 2003/0152192 | A1 | 8/2003 | Hasegawa | 378/53 |

FOREIGN PATENT DOCUMENTS

| | | |
|---|---|---|
| GB | 1191520 | 5/1970 |
| WO | WO 01/54137 A1 | 7/2001 |

*Primary Examiner*—Edward J. Glick
*Assistant Examiner*—Chih-Cheng Glen Kao
(74) *Attorney, Agent, or Firm*—Brinks Hofer Gilson & Lione

(57) ABSTRACT

An x-ray optical device includes an optic and an adjustable aperture that selectively occludes a portion of an x-ray beam. The adjustable aperture may be positioned between the optic and a sample and may be integrated with the optic or located in close proximity to the optic. The adjustable aperture enables a user to easily and effectively adjust the convergence of the x-rays. In doing so, the flux and resolution of the x-ray optical device can be optimized by using an optic having the maximum convergence allowed for all potential measurements, and then selecting a convergence for a particular measurement by adjusting the aperture.

20 Claims, 2 Drawing Sheets

X-RAY OPTICAL SYSTEM WITH ADJUSTABLE CONVERGENCE

RELATED APPLICATION

This application claims the benefit of U.S. Provisional Application No. 60/451,118, filed Feb. 28, 2003.

The entire contents of the above application is incorporated herein by reference.

BACKGROUND

The present invention relates to an x-ray optical system. More particularly, the present invention relates an x-ray optical system which conditions an x-ray beam.

Researchers have long employed focusing x-ray optics in x-ray diffraction experiments to increase the flux incident on the sample and hence to increase the signal to noise ratio. A focusing optic increases the flux by directing a large number of photons through the sample. Moreover, by positioning a detector near or at the focus of the optic, resolution of the system can be greatly improved.

However, for focusing multiplayer optics, the convergence angle of such optics limits their applicability in many applications, since for an application, a different convergence angle, and thus a different optic, is often needed for different types of samples. Moreover, a number of optics with different focal lengths are used to accommodate the needs of different applications. Hence, a different focusing optic is often used for the same measurement of different samples, or for different measurements of the same sample. Using different optics is inefficient and uneconomical since changing the optical elements is a costly and time consuming drain on researchers, in particular, and industry, in general.

Optics with an adjustable focal distances have been proposed. An example of such an optic is a traditional bending total reflection mirror. However, the alignment and adjustment of these mirrors are very time consuming and difficult to perform, and any imperfection in the alignment or adjustment of the optic degrades the system performance. Moreover, this approach cannot use multilayer optics, because of the inability of the bending total reflection mirrors to satisfy both the Bragg condition and geometric condition have to be satisfied simultaneously.

SUMMARY OF THE INVENTION

In view of the above, the present invention provides an x-ray optical device having a focusing optic and an adjustable convergence angle. The focusing optic has a convergence angle that is large enough for any particular application of interest. An adjustable aperture reduces the convergence angle by selectively occluding a portion of the x-ray beams. The x-ray beam incident on the sample comes from an optic with an adaptable convergence, but also with the requisite flux and resolution to improve the quality and efficiency of the x-ray diffraction process.

Of particular interest to the field of x-ray diffraction and scattering, such as small angle x-ray scattering and protein crystallography, is the conditioning of two-dimensional x-ray beams. For such applications, certain embodiments of the present invention include a confocal optical system with an adjustable aperture that is either integrated with or located in close proximity to the optic. By limiting the convergence of the beam in certain applications, the optic of the present invention provides a high-intensity and a two-dimensional x-ray beam with a pure spectrum and required divergence for use in diffraction and scattering applications.

Further features and advantages of the invention will be apparent from the drawings, detailed discussion, and claims.

DETAILED DESCRIPTION

In accordance with various embodiments of the invention, an improved x-ray optical device incorporates an adjustable aperture that enables a user to easily and effectively adjust the convergence of an incident beam of x-rays. In doing so, the flux and resolution of the x-ray system can be optimized by using an optic having the maximum convergence allowed for all potential measurements, and then selecting a convergence for a particular measurement by adjusting the aperture. Thus, the flux and resolution are easily adjusted and optimized for the needs of different applications or measurements, and hence the efficiency of the overall optical system is increased.

Figure 1:
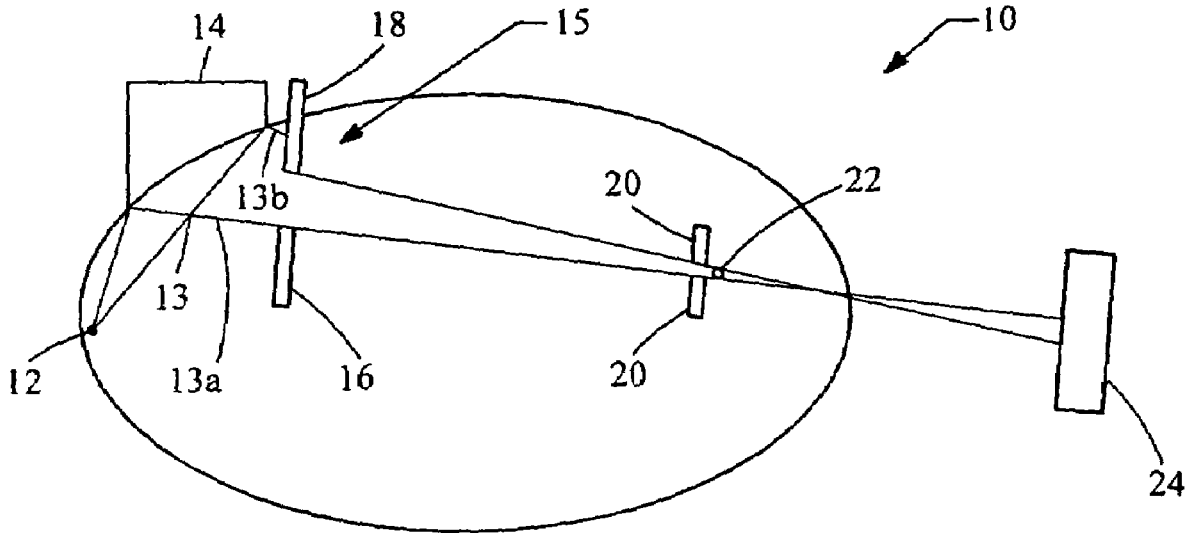
FIG. 1 is a schematic drawing of an x-ray optical system in accordance with the present invention.

Referring to FIG. 1 there is shown an x-ray optical device 10 with an x-ray source 12, an x-ray reflective optic 14, a first aperture 15, and a second aperture 20. The x-ray source 12 can be a laboratory source, such as a high brilliance rotating anode x-ray generator or a microfocusing source, and the x-ray reflective optic 14 can be, for example, a focusing multilayer optic with one or two reflective planes, a total reflection optic, or an x-ray reflective crystal.

The x-ray reflective optic 14 is a focusing optic with a convergence angle that is large enough for a range of applications. For example, if the measurements require a certain focal length and flux, the x-ray reflective optic 14 is selected so that those requirements are met, and the convergence angle is then adjusted with the apertures 15 and 20. Specifically, as a beam of x-rays is transmitted from the x-ray source 12 towards the reflective optic 14, the first aperture 15 and the second aperture 20 shape the reflected x-ray from the reflective optic 14.

The first aperture 15 includes a fixed portion 16 and a movable portion 18 that moves with respect to the fixed portion 16 to change the size and shape of the first aperture 15. The second aperture 20 is located adjacent to a sample 22, such as a biological sample or a protein, the image of which is captured by an x-ray detector 24.

As illustrated, the first aperture 15 is a double-bladed aperture. Specifically, the fixed portion 16 is a fixed blade and the movable portion 18 is a movable blade. However, the first aperture 15 can be any combination of a fixed and movable blade system, a fixed and movable pinhole system, a fixed and movable slit system, or a movable diaphragm. Moreover, if appropriate, the first aperture 15 can be a fixed pinhole or slit and a movable blade, or a fixed slit and a movable pinhole, provided that the movable portion 18 is its various embodiments is movable with respect to the fixed portion 16.

The second aperture 20 has a shape that maximizes the flux incident upon the sample 22 and yet blocks the x-ray that would not impinge on the sample if the x-ray were allowed to pass through the second aperture 20, thereby reducing the background radiation around the sample. The second aperture can be any combination of a slit, pinhole, or multiple blade system that effectively passes x-ray radiation on the sample 22 while occluding a portion of the x-ray radiation, such as errant or divergent x-rays.

In operation, the source 12 emits an x-ray field 13 in the direction of the x-ray reflective optic 14. The x-ray field 13 reflected by the optic 14 can generally be divided into a portion that is reflected from the near side of the x-ray reflective optic 14, identified as a near field 13*a,* and a portion that is reflected from the far side of the x-ray reflective optic 14, identified as a far field 13*b*.

As shown, the far field 13*b* portion of the reflected x-ray field 13 is occluded by the movable portion 18 when the first aperture 15 is set for low-convergence. Thus, only the near field 13*a* portion of the reflected x-ray field 13 is incident upon the sample 22. Reflecting the near field 13*a* from the portion of the x-ray reflective optic 14 that has the highest efficiency maximizes the flux incident on the sample 22. The movable portion 18 can be moved to a high-convergence position such that it does not occlude the far field portion 13*b* of the reflected x-ray field 13. Note that although FIG. 1 illustrates the one-dimensional characteristics of the x-ray optical device 10, the principles described above are equally applicable to x-ray optics which reflect x-ray fields in two dimensions, such as the x-ray optic 31 shown in FIGS. 4 and 5,.

Figure 2:
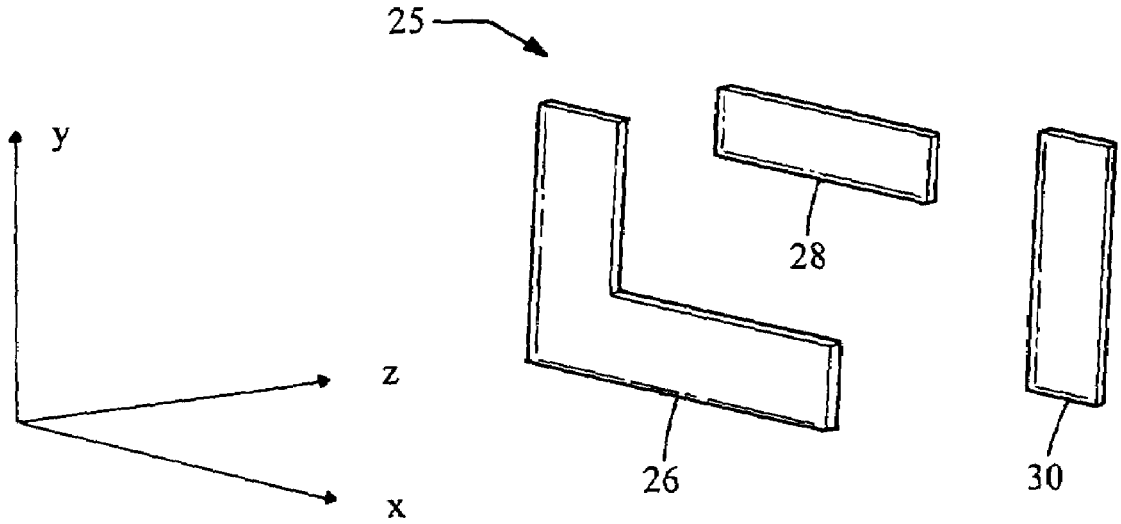
FIG. 2 is a perspective view of an adjustable aperture in accordance with the present invention.

Turning now to FIG. 2, there is shown the relative movement and placement of the components of a first aperture 25. A Cartesian coordinate system is provided in FIG. 2, with the z-axis designated as the direction of propagation of the x-rays, to better illustrate the features of the first aperture 25, The first aperture 25 includes a fixed portion 26 that generally has an L-shape. A first movable portion 28 is located behind the fixed portion 26 along the z-axis, and a second movable portion 30 is located behind the first movable portion 28 along the z-axis. The first movable portion 28 is movable in a vertical direction, that is, along the y-axis, and the second movable portion 30 is movable in a horizontal direction, that is, along the x-axis. In operation, the first and second movable portions 28, 30 move individually or in combination to increase or decrease the size of the passageway formed by the first aperture 25.

Figure 3:
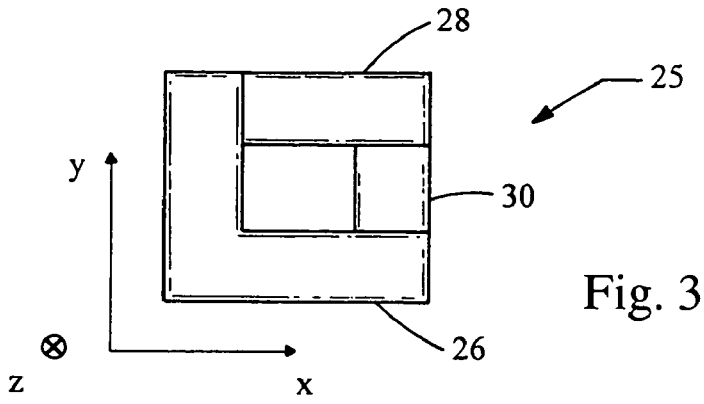
FIG. 3 is a view of the adjustable aperture along the optical axis.

Referring now to FIG. 3, a view of the first aperture 25 along the direction of propagation of the x-rays is shown, that is, along the z-axis. Since the fixed portion 26 generally has an L-shape and the first and second movable portions 28, 30 are generally rectangular, the passageway defined by the first aperture 25 is also generally rectangular or square in shape. However, the shape of the fixed portion 26, the first movable portion 28, and/or the second movable portion 30 can be modified to provide any desired shape for the resultant passageway. Thus, the operator can select the shapes of the fixed portion 26, the first movable portion 28, and the second movable portion 30, such that the first aperture 25 forms a beam with any desired cross-sectional shape.

Figure 4:
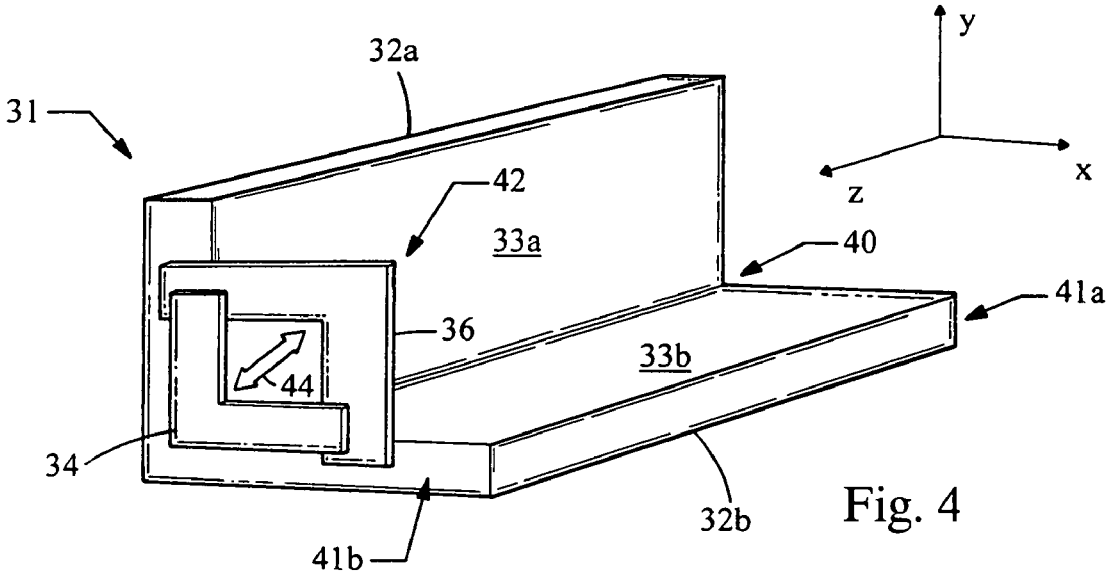
FIG. 4 is a perspective view of an x-ray optic having an integrated adjustable aperture in accordance with the present invention.
Figure 5:
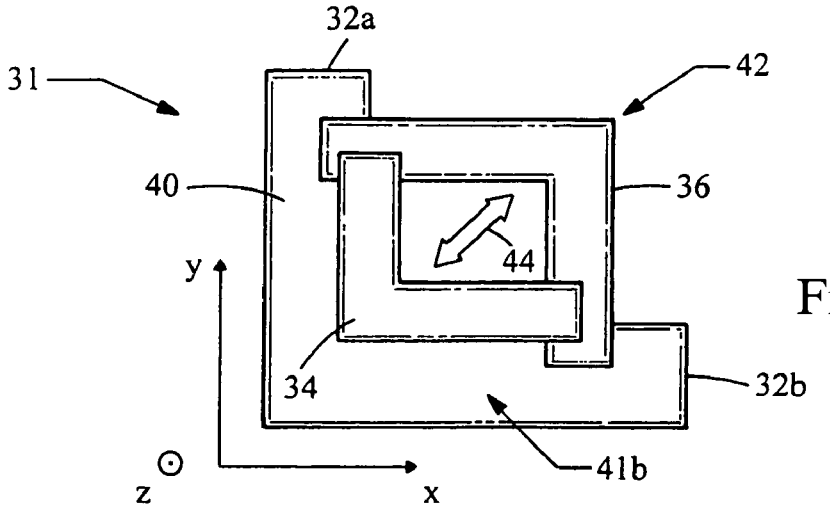
FIG. 5 is a view of the x-ray optic of FIG. 4 along the optical axis.

Turning now to FIGS. 4 and 5, there is shown the previously mentioned x-ray optic 31 as an integrated adjustable aperture in accordance with another embodiment of the present invention. A set of Cartesian axes is also provided in each of these figures to better illustrate the operation of the x-ray optic 31.

To vary the convergence of an x-ray beam in two dimensions, the x-ray optic 31 includes a confocal optic 40 and an adjustable aperture 42 attached to the confocal optic 40 for adjusting the profile angle. Note that the adjustable aperture 42 can be located in close proximity to the confocal optic 40 and therefore does not have to be attached to the confocal optic 40.

The confocal optic 40 includes a first optical element 32*a* lying in the y-z plane and a second optical element 32*b* lying in the x-z plane. The first optical element 32*a* defines a first reflective surface 33*a* and the second optical element 32*b* defines a second reflective surface 33*b*. In certain arrangements, the near or proximal portion 41*a* of the confocal optic 40 is located closest to an x-ray source, and the far or distal portion 41*b,* therefore, is located farther from the x-ray source and hence is less efficient than the near portion 41*a*. When the confocal optic 40 is in use, x-rays propagate along an optical axis, which is substantially parallel to the z-axis.

In some implementations, the first and second optical elements 32*a,* 32*b* are multilayer reflectors with graded d-spacing. Specifically, the first and second optical elements 32*a,* 32*b* may have either laterally graded d-spacing or depth graded d-spacing. Depending on the type of measurements performed with the x-ray optic 31, both the first reflective surface 33*a* and the second reflective surface 33*b* may have either an elliptic or parabolic shape or the reflective surfaces 33*a* and 33*b* may have different geometries. For example, one surface can have an elliptic shape and the other can have a parabolic shape.

Since the adjustable aperture 42 lies in the x-y plane and is coupled to the confocal optic 40, the adjustable aperture 42 is mutually orthogonal to the first and second optical elements 32*a,* 32*b*. In certain arrangements, the adjustable aperture 42 is located at or near the far portion 41*b* of the confocal optic 40, because for a higher system efficiency it may be advantageous to position the optic 40 as close to the source as possible and placing the aperture at or near the optic sharpens the beam since the beam has a divergence component. Alternatively, the aperture may be located between the source and the optic 40. However, placing the aperture in such a location may require some additional space between the optic and the source. Thus, such an arrangement may be employed if the system efficiency does not suffer unacceptably from increasing the distance between the optic and the source.

As shown, the adjustable aperture 42 includes a fixed portion 36 and a movable portion 34 that is movable with respect to the fixed portion 36 in the x-y plane, as indicated by the double arrow 44.

As described earlier, the adjustable aperture 42 is able to alter the convergence of an x-ray beam while maintaining the necessary flux incident on the sample. If the movable portion 34 moves along the arrow 44 towards the fixed portion 36, then the adjustable aperture 42 occludes x-rays that are reflected from the far portion 41*b* of the confocal optic 40. As for the near portion 41*a,* which is more efficient than the far portion 41*b,* the adjustable aperture 42 allows for a high-flux, low convergence x-ray beam to be conditioned and directed towards a sample. Conversely, the movable portion 34 can be moved away from the fixed portion 36 in the direction of arrow 44, permitting a higher convergence and higher flux to pass through the aperture 42 to the sample.

The fixed portion 36 and the movable portion 34 are substantially L-shaped, and thus the passageway defined by the adjustable aperture 42 is rectangular. However, like the components of the aperture 25, the shape of the fixed and movable portions 34, 36 may be determined by the requirements of a particular application to produce a beam with the desired cross-section. Thus, the fixed and movable portions 34, 36 may have shapes that are not necessarily L-shaped.

Accordingly, various embodiments of the present invention are directed to an x-ray optical device having at least one aperture that is adjustable to optimize the beam convergence, as well as the flux incident on a sample. In particular, the aperture is adjustable in one or two dimensions and it may be integrated into a two dimensional optical element, which is particularly well suited, for example, for small angle x-ray scattering and protein crystallography.

Other embodiments are within the scope of the following claims.

What is claimed is:

1. An x-ray optical system for analyzing a sample comprising:

an optic which conditions an x-ray beam, the optic defining a near end and a far end and including a first optical element defining a first reflective surface and a second optical element defining a second reflective surface orthogonal to the first reflective surface, the first and second reflective surfaces reflecting x-rays transmitted from an x-ray source to the sample;

an adjustable first aperture which adjusts convergence of the x-ray beam by selecting a portion of the x-ray beam delivered by the optic, the first aperture being positioned between the optic and the sample, wherein the first aperture includes a fixed portion and a movable portion that is movable relative to the fixed portion, the first aperture being adjusted by moving the movable portion relative to the fixed portion to change a size or shape of the x-ray beam; and a second aperture which maximizes flux incident on the sample by occluding a portion of the x-ray beam to reduce background radiation around the sample, the second aperture being positioned between the first aperture and the sample.

2. The x-ray optical system of claim 1 wherein the first aperture is a diaphragm.

3. The x-ray optical system of claim 1 wherein the fixed portion is a fixed blade and the movable portion is a movable blade.

4. The x-ray optical system of claim 3 wherein the fixed blade and the movable blade are positioned at or near a distal portion of the optic relative to the source.

5. The x-ray optical system of claim 3 wherein the fixed blade and the movable blade are each substantially L-shaped.

6. The x-ray optical system of claim 3 wherein the movable blade is movable from a high-convergence position to a low-convergence position.

7. The x-ray optical system of claim 6 wherein in the low-convergence position, the movable blade occludes x-rays reflected from a far portion of the optic.

8. The x-ray optical system of claim 3, wherein the fixed blade occludes x-rays reflected from a near portion of the optic and the movable blade occludes x-rays reflected from a far portion of the optic.

9. The x-ray optical system of claim 1 wherein the optic is a two-dimensional optical element.

10. The x-ray optical system of claim 1 wherein at least one reflective surface has a substantially elliptic shape.

11. The x-ray optical system of claim 10 wherein both reflective surfaces have a substantially elliptic shape.

12. The x-ray optical system of claim 10 wherein one reflective surface has a substantially elliptic shape and the other reflective surface has a substantially parabolic shape.

13. The x-ray optical system of claim 1 wherein at least one reflective surface has a substantially parabolic shape.

14. The x-ray optical system of claim 13 wherein both reflective surfaces have a substantially parabolic shape.

15. The x-ray optical system of claim 1 wherein the first optical element is a first multilayer optic and the second optical element is a second multilayer optic.

16. The x-ray optical system of claim 15 wherein the first multilayer optic and the second multilayer optic have graded d-spacing.

17. The x-ray optical system of claim 16 wherein the first multilayer optic and the second multilayer optic have depth graded d-spacing.

18. The x-ray optical system of claim 16 wherein the first multilayer optic and the second multilayer optic have laterally graded d-spacing.

19. The x-ray optical system of claim 1 wherein the first optical element is a first x-ray reflective crystal and the second optical element is a second x-ray reflective crystal.

20. The x-ray optical system of claim 1 wherein the first aperture is attached to the far end of the optic.

* * * * *